US006494549B2

(12) United States Patent
Van Daalwyk

(10) Patent No.: US 6,494,549 B2
(45) Date of Patent: Dec. 17, 2002

(54) SPACE SAVING PRESSURIZED CYLINDER RECEIVING COMPARTMENT

(76) Inventor: Dennis R. Van Daalwyk, 385 Frances, St. Menasha, WI (US) 54952

( * ) Notice: Subject to any disclaimer, the term of this patent is extended or adjusted under 35 U.S.C. 154(b) by 0 days.

(21) Appl. No.: 09/788,095

(22) Filed: Feb. 20, 2001

(65) Prior Publication Data

US 2002/0113528 A1 Aug. 22, 2002

(51) Int. Cl.[7] ..... B65D 3/04

(52) U.S. Cl. ..... 312/72; 211/81; 211/85.18; 312/9.4; 312/45; 312/209

(58) Field of Search ..... 312/72, 73, 9.2, 312/9.4, 22, 26, 34.2, 45, 123, 202, 270.2, 34.3, 34.8, 120, 200; 211/85.18, 81, 74

(56) References Cited

U.S. PATENT DOCUMENTS

| | | | | | |
|---|---|---|---|---|---|
| 817,956 | A | * | 4/1906 | Carman | 312/9.4 X |
| 859,817 | A | * | 7/1907 | Kersey | 312/209 X |
| 2,317,064 | A | * | 4/1943 | Josephian | 211/85.18 X |
| 4,243,145 | A | * | 1/1981 | Woodhead | 312/45 X |
| 4,305,512 | A | * | 12/1981 | Mackenzie | 312/45 X |
| 4,481,972 | A | * | 11/1984 | Stavlo | 108/55.1 X |
| 4,944,924 | A | * | 7/1990 | Mashwirt et al. | 211/74 X |
| 5,404,921 | A | | 4/1995 | Lamoreaux et al. | |

* cited by examiner

*Primary Examiner*—Peter M. Cuomo
*Assistant Examiner*—Michael J. Fisher
(74) *Attorney, Agent, or Firm*—Russell L. Johnson

(57) ABSTRACT

A rectangular compartment for receiving and dispensing pressurized gas cylinders. The compartment, for its use, requires a minimal space both inside and outside the compartment. The compartment contains a tank receiving unit configured to receive multiple tanks arranged in files. The tank receiving unit is pivoted near its center of mass so as to permit easy rotation in place of the tank receiving unit. The compartment is provided with an access door. When the access door is open and the tank receiving unit is rotated outward to receive tanks, the tank receivers in a file project a short distance outside the compartment and are arranged one above the other. When the access door is closed, the tanks are in an upright position and secured in that position by an interlock between the tank receiving unit and the access door.

9 Claims, 4 Drawing Sheets

SPACE SAVING PRESSURIZED CYLINDER RECEIVING COMPARTMENT

BACKGROUND OF THE INVENTION

1. Field of the Invention

This invention relates to a compartment having pivoting receivers for pressurized tanks.

More specifically, this invention relates to the compartment described above wherein the access to the compartment has a minimal width so as to permit the enclosure to be secured in a cabinet or on a vehicle or the like so as to require a minimum opening width.

2. Description of the Related Art

Pressurized cylinders are used in a variety of applications. Pressurized cylinders are often provided with a compartment for receiving and dispensing them for a number of general reasons. One reason is to provide protection for the cylinders. A second reason is to incorporate the cylinders into an apparatus or piece of equipment. A third reason is to provide containment for a sudden discharge or explosion should there be a malfunction of some sort related to the cylinders.

Pressurized cylinders are placed in compartments in order to achieve a number of utilities. The principal utilities of compartments for pressurized cylinders are; to charge or fill the cylinders, to discharge or dispense gas from the cylinders, or to store the cylinders.

Compartments for pressurized cylinders can be stand alone units, but more frequently, they are incorporated into the structures of work stations, vehicles, air and water craft, or are incorporated into the structures of apparatus.

Heretofore, compartments for receiving pressurized cylinders were specific to their application and were designed for locations and circumstances related to that application.

U S. Pat. No. 5,404,921 to Lamoreaux et al. teaches a Rotary Fill Station for Breathing Apparatus. The station is provided with a fragment containment chamber having a carousel mounted to rotate about a vertical axis for the purpose of moving pressurized cylinders into and out of a fill chamber.

In general, the volume required for the compartment of Lamoreau and other similar prior art compartments is large relative to the volume of the cylinders contained within the compartment. In particular, the width of the front or access area is wide relative to the diameter of a tank contained therein.

It is an object of this invention to provide a general utility chamber for receiving and containing pressurized gas cylinders.

It is further an object of this invention to provide the chamber described above wherein the volume occupied by the chamber is smaller than similar prior art chambers.

More particularly it is an object of this invention to provide the chamber as described above wherein the width of the chamber is minimal.

Still more particularly it is an object of this invention to provide the chamber as described above with a rotating tank receiving unit which extends outward from the access opening when in a position to receive cylinders and the cylinders are received so that they enter the tank receivers one above the other and when the tank receiving unit is rotated into an upright position inside the compartment, the tanks are upright and one behind the other.

Other objects will become obvious from the following specifications, claims and drawings.

SUMMARY OF THE INVENTION

A space saving compartment for pressurized tanks, comprising: a rectangular metal compartment having a front, a back, a top, a bottom and two sides and the front is provided with an access door, tank mounts secured to the inside of the sides of the compartment and the tank mounts are positioned below the center of the compartment and closer to the front of the compartment than they are to the back, a tank receiving unit contained within the compartment and the tank receiving unit has a front, a back, a top, a bottom, and two sides and the two sides are provided with pivots projecting laterally outward from the sides to form a horizontal pivot axis and the pivots are pivotably engaged with the tank mounts, a multiplicity of cylindrical tank receivers formed as a part of the tank receiving unit and the tank receivers are open at their tops and the tank receivers have their cylindrical center lines parallel, and the tank receiving unit when rotated about its pivots projects outward from the compartment so that tank receivers in a file are positioned one over the other with their open tops in position to receive tanks, and when the tank receiving unit is rotated about its pivots so that the tanks contained therein are upright, and the compartment door is closed, the width of the compartment is minimal.

DETAILED DESCRIPTION OF THE INVENTION

Figure 2:
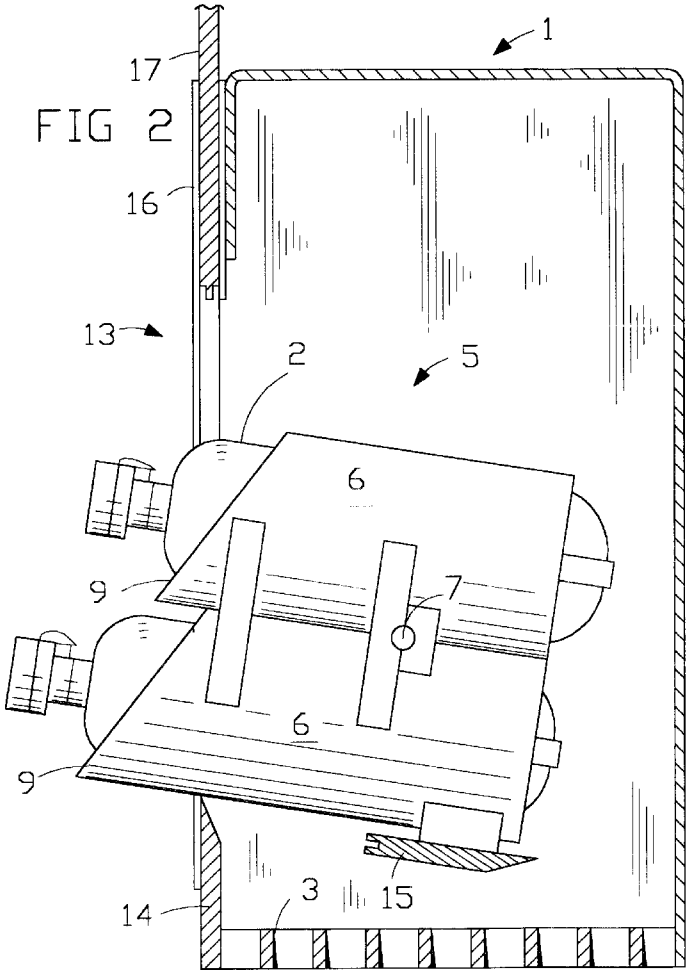
FIG. 2 is a sectioned side elevational view of the compartment of FIG. 1 showing the tank receiving unit rotated towards the front of the compartment.

In the drawings like numbers refer to like objects and the proportions of some elements have been changed to facilitate illustration. The construction details are simplified and partially schematic to avoid the recitation of noncritical details which would cause the specifications and drawings to become prolix.

Referring now to FIGS. 1 through 4 wherein space saving compartment 1 is shown as a stand alone compartment. Compartment 1 is a space saving compartment for pressurized tanks. The compartment is readily incorporatable into the structures of work stations, counters, portable apparatus, service and emergency vehicles, boats and the like. Because compartment 1 can serve several utilities in a variety of situations related to pressurized tanks and the tanks may have a diversity of contents, the inventive concept is shown in FIGS. 1–4 in its basic configuration and it should be understood that compartment 1 is a compartment that is adaptable to numerous configurations and applications without departing from the inventive concept.

Pressurized tanks 2 contain a gas under pressure. In some applications the gas is combustible. For that reason compartment 1 is typically made to direct a discharge or an explosion downward and to suppress the escape of fragments. Compartment 1 is typically made of heavy gauge metal with a vented bottom 3 shown in the figures to be supported above its base by legs 4.

Further, in one aspect of the invention tank receivers 6 are formed of a heavy wall thickness metal tubing such as schedule 40 steel tube having a wall thickness in the order of one fourth inch. This serves to contain fragments and protect the tanks therein from fragments while directing discharges downward.

Compartment 1 is provided with a tank receiving unit 5 which is pivotably mounted in the compartment and comprises cylindrical tank receivers 6 positioned in the compartment so that their center lines are parallel and in a plane parallel to sides 10 to form a file, and with transverse pivots 7 which are pivotably mounted in pivot mounts 8 secured to sides 10. Pivots 7 are located near the center of mass of tank receiving unit 5 to facilitate pivoting tank receiving unit 5.

Figure 5:
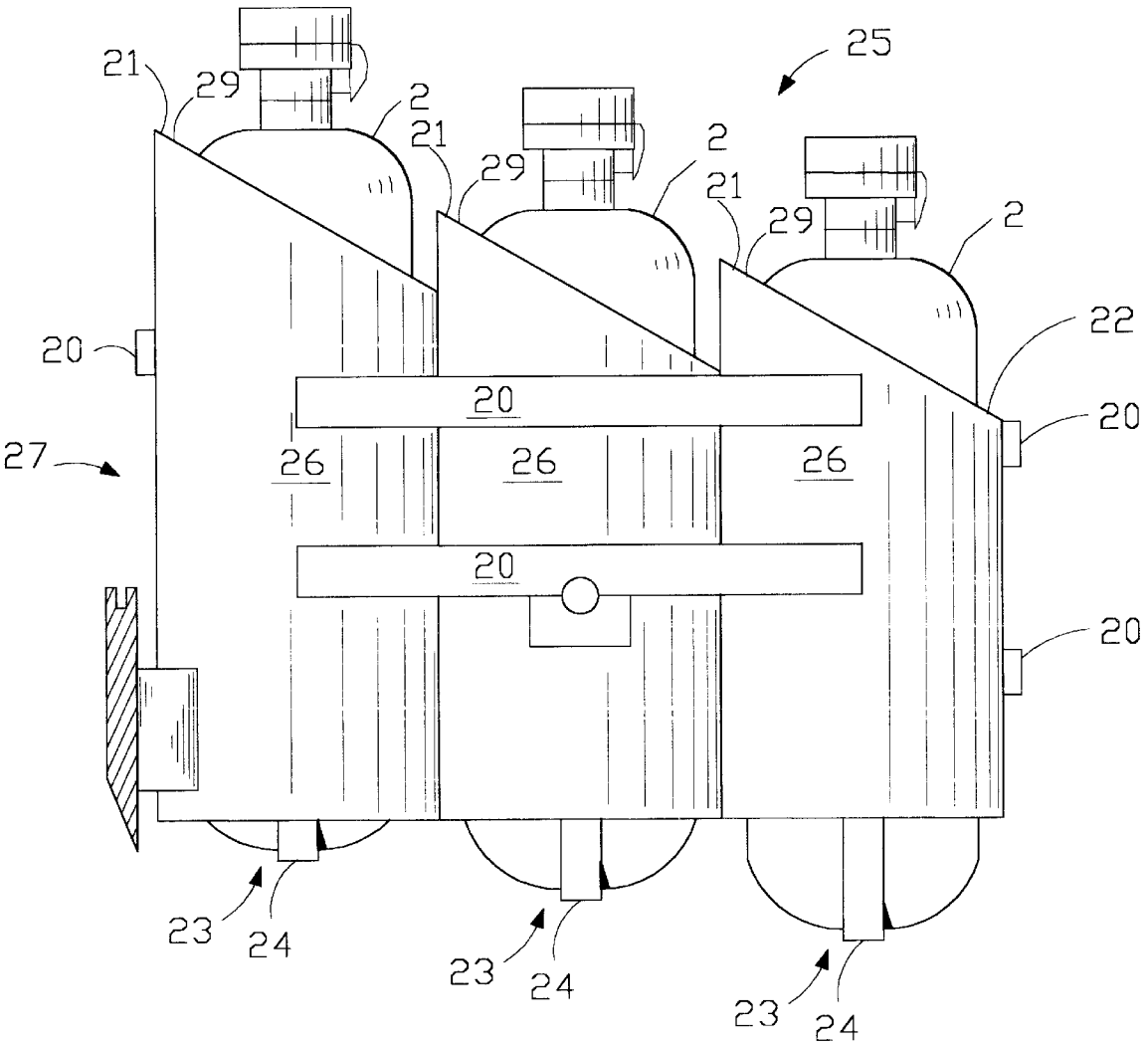
FIG. 5 is a side elevational view of a preferred embodiment of a tank receiving unit for the compartment of FIG. 1
Figure 6:
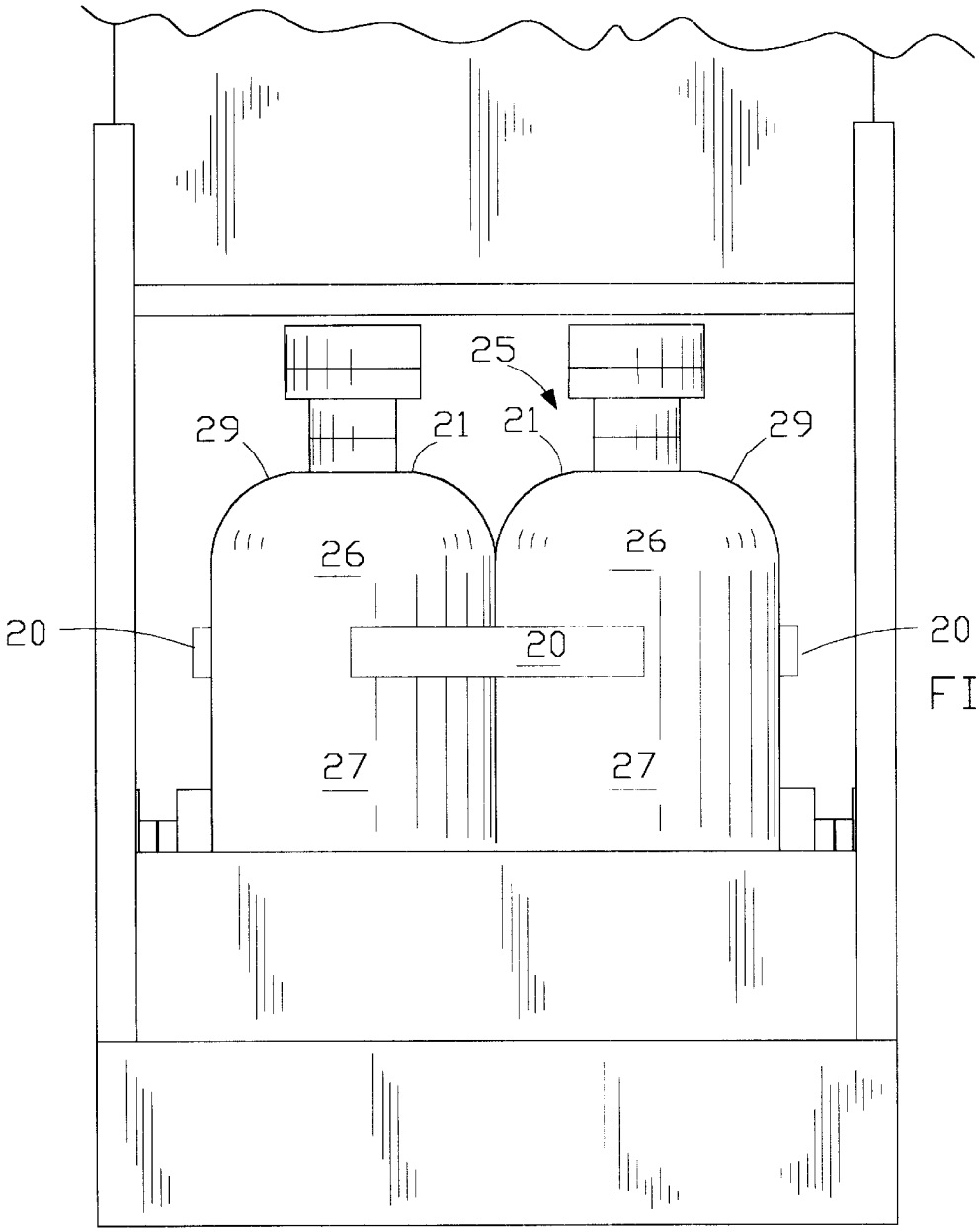
FIG. 6 is a front elevational view of the tank receiving unit of FIG. 5.

It should be understood that it is within the scope of this invention to provide a tank receiving unit 5 that will have more than two tank receivers 6 in a file and/or more than one file per tank receiving unit as shown in FIGS. 5 and 6. and that multiple compartments 1 can by installed side by side to form a magazine. Typically, the width of compartment 1 is 4–6 inches wider than the tank receiving unit employed in the compartment so as to provide a minimum width compartment. The provision of a minimum width compartment is of significant value in applications where cabinet or wall space is at a premium as it is on emergency vehicles, hospital counters and portable equipment.

EXAMPLE

A compartment made according to this invention for receiving and dispensing compressed air cylinders commonly used in SCUBA diving wherin the cylinders have a nominal diameter of 7.5 inches has a tank receiving unit width of 8.75 inches and a compartment width of 13.125 inches.

Figure 1:
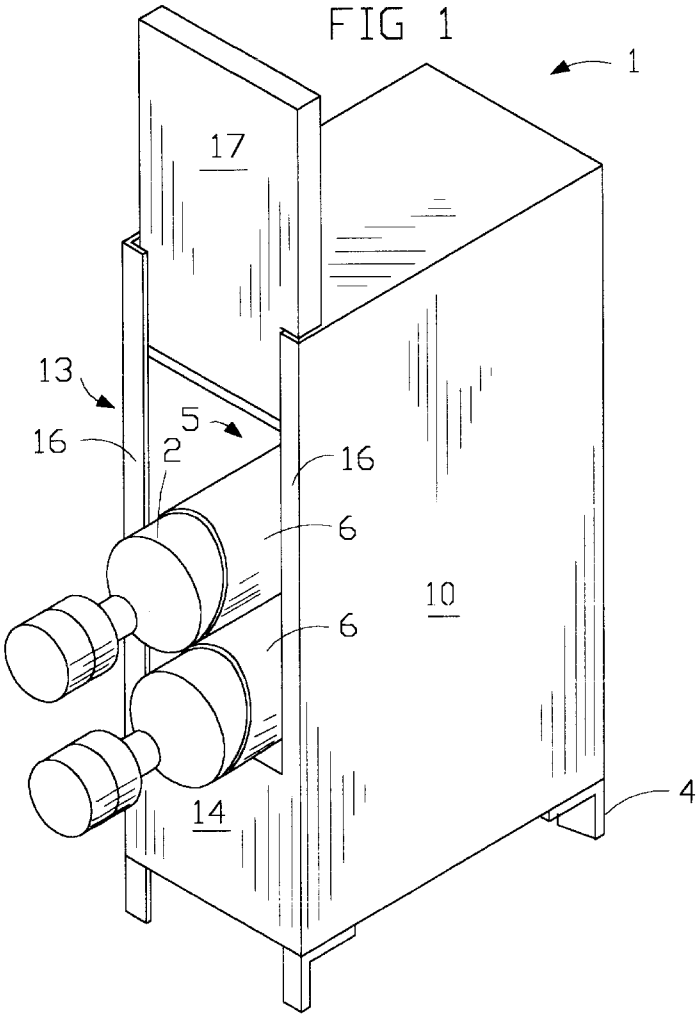
FIG. 1 is a pictorial view of the compartment of this invention.

Tanks 2 are heavy and present problems with placing and securing them in an upright file in the compartment and in removing them from the interior of the compartment. Pivoting tank receiving unit 5 provides a novel solution to the problem. Pivot mounts 8 for tank receiving unit 5 are located below the center of compartment 1 and towards the front of compartment 1, as shown in FIGS. 1–4. Tank receiving unit 5 when pivoted to near horizontal, presents the open tops 9 of tank receivers 6 outside compartment 1 and with tank receivers 6 positioned one above the other so as to facilitate the placing in and removal of tanks 2 into and out of tank receivers 6 as shown in FIGS. 1 and 2.

Another novel aspect of this invention resides in the closure for the access opening 13. While it should be understood that compartment 1 having tank receiving unit 5 pivotably mounted therein could serve its intended purposes by employing a hinged closure and latch, the novel closure 13 illustrated in FIGS. 1–4 provides a multifunction closure for compartment 1 while eliminating the need to provide for door swing.

Figure 4:
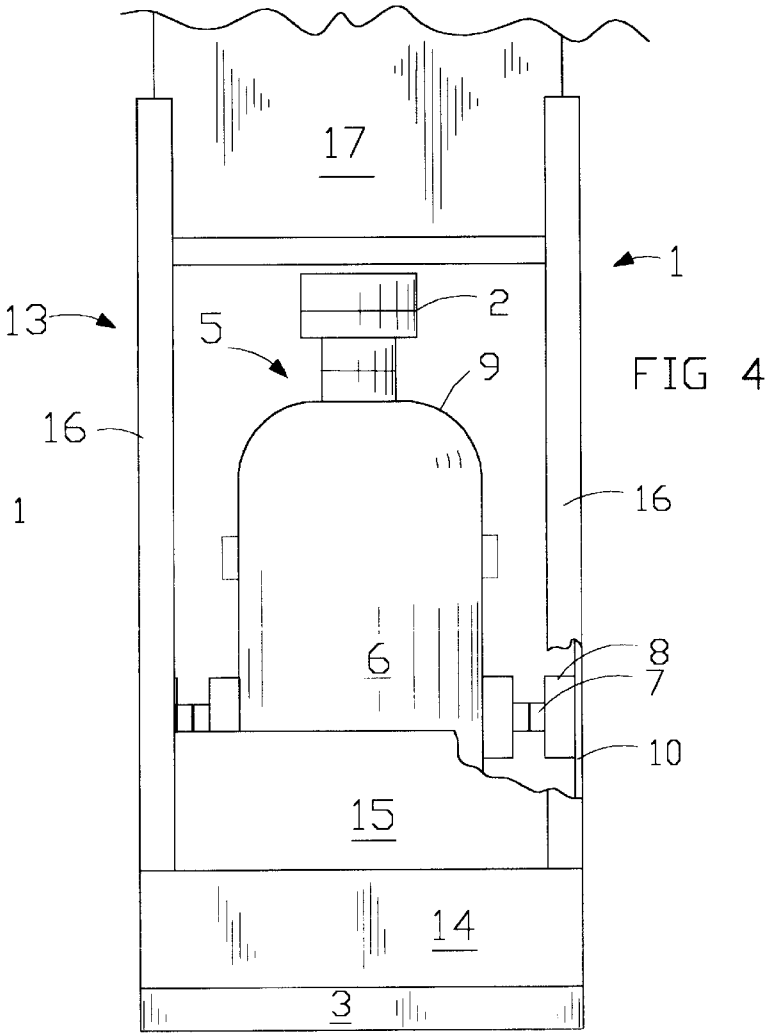
FIG. 4 is a front elevational view of the tank receiving unit of FIG. 3 With the access door open.
Figure 3:
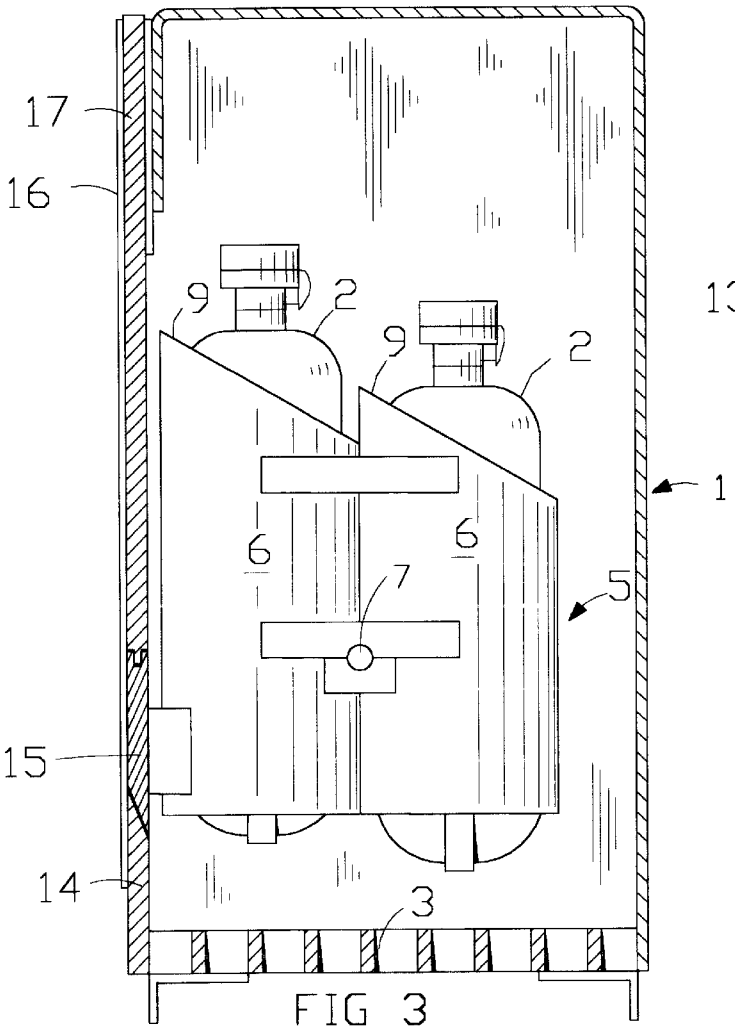
FIG. 3 is a sectioned side elevational view of the compartment FIG. 1 showing the tank receiving unit rotated into an upright position with the access door closed.

Compartment 1 is provided with a fixed front panel 14 which defines the bottom of access opening 13 and serves a rest for tank receiving unit 5 when tank receiving unit 5 is rotated into access opening 13. Tank receiving unit 5 has secured to its front a door segment 15 which engages the top of front panel 14 and side guides 16 when tank receiving unit 5 is in the upright position as shown in FIGS. 3 and 4. Sliding door panel 17 is moved vertically in side guides 16 to engage the top of door segment 15 when in the lowered position and to create access opening 13 when in the raised position.

The above disclosures are enabling so as to permit one skilled in the art to make and use the compartment, tank receiver and closure of this invention without undue experimentation. The inventors duty to disclose the best mode of practicing his invention known to him at the time the invention was made obliges the inventor to add the following disclosures to his patent application.

The minimal width of compartment 1 is of critical importance to the space saving utility of the invention. Tank receiving unit 5 has a width that is equal to the inside diameter of tank receiver 6 plus the wall thicknesses of tank receiver 6. The clearance needed for pivots 7 and pivot mounts 8 is in the order of 1.5 inches to 1.75 inches on each side. The wall thickness of compartment 1 is typically in the order of 0.25 inches.

The placement of pivots 7 below the center of mass of tank receiving unit 5 combined with the placement of pivot mounts 8 below and to the front of the center of compartment 1 permits the rotation of tank receiving unit through an angle in the order of 80 degrees so that the open tops of tank receivers 6 project out of access opening 13 when rotated outward. This mode of pivoting tank receiving unit 5 presents the open tops 9 of tank receivers 6 outside compartment 1 and one above the other which facilitates the insertion of tanks 2 into tank receiving unit 5 and the removal of tanks 2 from tank receiving unit 5. This mode of rotation also reduces the overall depth of compartment 1 required to achieve the above described rotations.

The placement of pivots 7 to the front of the center of compartment 1 permits the front of tank receiving unit 1 to be at the front of compartment 1 when tank receiving unit 5 is rotated into the upright position. This enables the securement of door segment 15 to the front of tank receiving unit 5 so that when tank receiving unit 5 is in the upright position, door segment 15 engages the top of fixed front panel 14 and side guides 16. Sliding door panel 17 engages door segment 15 when panel 17 is in the lowered position so as to lock door segment 15 in place and thereby secure tank receiving unit 5 in place adjacent to sliding door panel 17. To open access opening 13, sliding door panel 17 is raised sufficiently to permit tank receiving unit 5 to be rotated outward from compartment 1. The short distance that sliding door panel 17 needs to be raised to rotate tank receiving unit 5 outward from compartment 1 reduces the degree to which the closure of compartment 1 encroaches on adjacent compartments and contributes to the frontal space saving attributes of the compartment of this invention.

Referring now to FIGS. 5 and 6 wherein a tank receiving unit 25 is shown to contain two files 27 of tank receivers 26 with three tank receivers 26 in each file. In this embodiment tank receiving unit 25 is made unitary by welding cylindrical tank receivers 26 together by means of attachment strips 20. Open tops 29 are shown to be at an angle to the body of tank receivers 26 so that when tank receiver 25 is rotated outward, lower lip 21 projects outward farther than upper lip 22 and the lower lip 21 of one tank a receiver 26 projects over the upper lip 22 of the tank receiver 26 below it. Closed bottoms 23 of tank receivers 26 are closed by means of cross straps 24. Cross straps 24 are progressively longer as they progress to the back of a file of tank receivers 26 as shown in FIG. 5 so that the tops of tanks 2 are positioned progressively lower towards the back of the file. This further facilitates the ease of placing tanks 2 into and removing tanks 2 from tank receivers 26 while at the same time reducing the height that a sliding door panel needs to be raised in order to clear the top of the last tank 2 in the file when tank receiving unit 25 is rotated outward.

The above disclosures of the space saving compartment of this invention and the best mode of practicing the invention is enabling so that one skilled in the art can make and use the invention for its intended purposes. However to disclose all the variants of the compartment and its tank receiving unit that are within the scope of this invention would greatly multiply the drawings and cause the specifications to become prolix. Therefore, the scope of the invention should not be limited by the scope of the disclosed embodiments, but that the scope of this invention should only be limited by the scope of the appended claims and all equivalents thereto that would be made apparent thereby to one skilled in the art.

What is claimed is:

1. A space saving compartment for pressurized tanks, comprising:

a) a rectangular metal compartment having a front, a back, a top, a bottom and two sides and the front is provided with an access door, b) tank mounts secured to the inside of the sides of the compartment and the tank mounts are positioned below the center of the compartment and closer to the front of the compartment than they are to the back, c) a tank receiving unit contained within the compartment and the tank receiving unit has a front, a back, a top, a bottom, and two sides and the two sides are provided with pivots projecting laterally outward form the sides to form a horizontal pivot axis and the pivots are pivotably engaged with the tank mounts and the pivots are located near the center of mass of tank receiving unit, d) a multiplicity of cylindrical tank receivers formed as a part of the tank receiving unit and the tank receivers are open at their tops and the tank receivers have their cylindrical center lines parallel and in a plane parallel to the sides of the tank receiving unit to form a file, and e) the tank receiving unit when rotated about its pivots projects outward from the compartment so that tank receivers are positioned one over the other with their open tops in position to receive tanks, and when the tank receiving unit is rotated about its pivots so that the tanks contained therein are in an upright file, and the access door is closed, the front of the tank receiving unit is adjacent to the access door.

2. The compartment of claim 1 wherein the tank receiving unit has a width and the compartment has a width and the width of the compartment is no more than six inches greater than the width of the tank receiving unit.

3. The compartment of claim 1 wherin the front of the compartment comprises a lower fixed front panel which is secured in place at the bottom front of the compartment, a door segment secured to the front of the tank receiving unit, and which engages with the front panel when the tank receiving unit is in an upright position, and a sliding door panel which engages the door segment and is raised and lowered vertically in side guides to open and close the access opening.

4. The compartment of claim 1 wherein the tank receiving unit comprises more than two tank receivers in a file.

5. The compartment of claim 1 wherein the tank receiving unit comprises more than one file.

6. The compartment of claim 1 wherein the tank receivers have their open tops angled to the bodies of the tank receivers and the angled tops are positioned in the file so that the lower lip of one tank receiver projects beyond the upper lip of a lower tank receiver when the tank receiving unit is rotated outward.

7. The compartment of claim 1 wherein the bottoms of the tank receivers are closed by means of a cross strap and the cross straps are progressively longer from front to back of the file of tank receivers so that the tops of pressurized tanks in the tank receivers will be progressively lower when the tank receiving unit is in the upright position.

8. The compartment of claim 1 wherein the tank receivers are formed of heavy walled steel tubing having open tops and bottoms and the bottoms are provided with a cross strap for supporting the tanks in the tank receivers.

9. A space saving compartment for pressurized tanks, comprising:

a) a rectangular metal compartment having a front, a back, a top, a bottom and two sides and the front is provided with an access door, b) tank mounts secured to inside of the sides of the compartment and the tank mounts are positioned below the center of the compartment and closer to the front of the compartment than they are to the back, c) a tank receiving unit contained within the compartment and the tank receiving unit has a front, a back, a top, a bottom, and two sides and the two sides are provided with pivots projecting laterally outward form the sides to form a horizontal pivot axis and the pivots are pivotably engaged with the tank mounts and the pivots are located near the center of mass of tank receiving unit, d) two cylindrical tank receivers formed as a part of the tank receiving unit and the tank receivers are open at their tops and the tank receivers have their cylindrical center lines parallel and in a plane parallel to the sides of the tank receiving unit to form a file, e) the tank receiving unit when rotated about its pivots projects outward from the compartment so that tank receivers are positioned one over the other with their open tops in position to receive tanks, and when the tank receiving unit is rotated about its pivots so that the tanks contained therein are in an upright file, and the access door is closed, the front of the tank receiving which is adjacent to the access door, and f) the tank receiver has a nominal width of eight and three quarters of an inch and the compartment has a nominal width of thirteen and one eighth inches.

* * * * *